US005279278A

United States Patent [19]

Logtens et al.

[11] Patent Number: 5,279,278

[45] Date of Patent: Jan. 18, 1994

[54] BURNER UNIT

[75] Inventors: Gerardus M. C. J. Logtens, Holthees; Martinus J. C. Van Liempt, Arnhem, both of Netherlands

[73] Assignee: Stork Contiweb B.V., Netherlands

[21] Appl. No.: 929,534

[22] Filed: Aug. 14, 1992

[30] Foreign Application Priority Data

Aug. 20, 1991 [NL] Netherlands ..... 9101408

[51] Int. Cl.[5] ..... F24H 3/00

[52] U.S. Cl. ..... 126/116 R; 126/99 A; 126/85 R; 126/90 R; 34/155; 432/59; 432/148; 432/72; 432/209

[58] Field of Search ..... 126/116 R, 101, 109, 90 R, 99 A, 86, 88, 89, 85 R; 432/213, 148, 432/8, 11, 72, 213, 212, 209, 148, 175, 193; 122/16, 14, 43, 179; 34/155

[56] References Cited

U.S. PATENT DOCUMENTS

| | | | |
|---|---|---|---|
| 2,091,172 | 8/1937 | Wilson | 432/209 X |
| 3,706,445 | 12/1972 | Gentry | 432/72 |
| 4,310,300 | 1/1982 | Mackenzie | 432/148 X |
| 4,391,227 | 7/1983 | Förster | 126/116 R X |
| 4,944,673 | 7/1990 | Jacobs et al. | 432/72 X |

FOREIGN PATENT DOCUMENTS

| | | |
|---|---|---|
| 0326227 | 8/1989 | European Pat. Off. . |
| 0326228 | 8/1989 | European Pat. Off. . |
| 8902895 | 6/1991 | Netherlands . |
| 9101408 | 6/1991 | Netherlands . |

*Primary Examiner*—Larry Jones

*Attorney, Agent, or Firm*—Wegner, Cantor, Mueller & Player

[57] ABSTRACT

A burner unit for heating a gaseous medium includes a heat exchanger provided with tubes, a space between the tubes connected on the upstream side to a feed duct for the gaseous medium; a combustion chamber connected to the downstream side of the space between the tubes; a burner placed in the combustion chamber; and a fuel supply duct connected to the burner. The side of the combustion chamber remote from the heat exchanger is connected to a first end of the tubes; and a flue gas outlet duct is connected to the other end of the tubes. The elongation of the tubes forming part of the heat exchanger renders the use of a conventional tube plate superfluous. Thus, damage resulting from thermal stresses is avoided.

12 Claims, 5 Drawing Sheets

BURNER UNIT

The invention relates to a burner unit for heating a gaseous medium comprising:

a heat exchanger provided with tubes, wherein the space between the tubes on the upstream located side is connected to a feed duct for the gaseous medium for heating;

a combustion chamber arranged connecting onto the heat exchanger and connected to the downstream located side of the space between the tubes in the combustion chamber;

a burner placed in the combustion chamber;

a fuel supply duct connected to the burner;

a connecting duct received in the combustion chamber and connecting the side of the combustion chamber remote from the heat exchanger to a side of the tubes forming part of the heat exchanger; and a flue gas outlet duct connected to the other side of the tubes forming part of the heat exchanger.

Such burner units are known from the Netherlands patent application number 8902825.

In this known burner unit the gas for heating is supplied via a heat exchanger, wherein in the heat exchanger it is fed through between the tubes forming part of the heat exchanger, whereafter the gas for heating arrives in the combustion space where it is burnt together with fuel supplied via a fuel supply line. Use is made for the combustion of oxygen present in the gas for heating.

It is herein possible that the gas for heating is only heated, as described in the cited patent application, for instance to apply a drying action.

It is further possible that, when such a burner unit is for example used for a drier employed in the graphic industry, the gas for heating comprises flammable oils or solvents. These are in this case burnt simultaneously in the burner with the fuel. A portion of the resulting combustion products is discharged on the other side of the combustion chamber by means of an additional outlet duct, as expounded in claim 2, and, in the case of a drier, used for performing a drying process. Another portion of the combustion gases is fed back via a connecting duct to the heat exchanger where the combustion gases surrender their heat to freshly supplied gas for heating. In order to obtain complete combustion of the evaporated solvents and oils a high burner temperature is required. The combustion gases are subsequently discharged via the outlet duct by means of a chimney outlet.

It is, however, possible to omit the additional outlet duct, when the burner unit is used only for burning the flammable constituents contained in the gases.

With the above known device a good heating of the gas for heating is obtained, while, due to the possibility of burning the oils and solvents present in the gas for heating, on the one hand these substances are prevented from contaminating the environment and on the other the quantity of fuel required is reduced. The ratio between the quantity of gas supplied directly from the combustion chamber to the drying device and the portion supplied to the chimney outlet after surrendering heat in the heat exchanger can be controlled by a suitable control device, wherein this control device aims to maintain the desired temperature inside the drier while meeting safety standards, so that the best possible drying process is obtained.

In these known devices, a tube plate in which the tubes forming part of the heat exchanger are fixed is arranged near the hot part of the heat exchanger, that is, at the division from the combustion chamber. The plate then also forms the closure of the heat exchanger, wherein the interior of the heat exchanger between the tubes is in communication with the burner space and the interior of the tubes in communication with the connecting ducts.

It will be apparent that a high temperature prevails in the vicinity of the burner, which means for instance that when the burner flame is ignited respectively extinguished this plate arranged in the proximity of the burner is subjected to high thermal stresses. As a result the plate, and particularly the weld connection between the plate and the tubes, forms a critical component that is highly stressed. This may lead to the undesired situation that the interior of the heat exchanger to which the gas for heating is supplied is in direct communication with the interior of the tubes with which the heated gas is discharged to the chimney outlet.

Firstly, this reduces the yield of the burner unit and secondly there is the danger that, when the gas for heating is contaminated with solvents or oils, these will enter the chimney outlet unburnt and subsequently contaminate the environment.

The aim of the present invention is to avoid the above problem.

This aim is reached in that the connecting duct is formed by elongating the tubes forming part of the heat exchanger.

As a consequence of this step the tube plate becomes superfluous so that the drawbacks associated with this tube plate are obviated.

It will be apparent that the tubes must nevertheless be fixed at one of their ends. For this purpose a tube plate is arranged on the side of the chimney outlet of the heat exchanger. Although with this tube plate joins must also be formed between the tube plate and the tubes, the weld connections are less problematic here because the temperature variations on this side of the heat exchanger are much smaller, so that high thermal stresses are avoided.

An additional advantage is that in the case of the tube plate on the side of the chimney outlet the distance between the tubes is generally greater so that the weld connections can be made more easily and will partly for this reason be of better quality.

The invention subsequently relates to two alternative embodiments of the invention, wherein the tubes are bent so that either the connecting duct and a part of the burner are situated on either side of the heat exchanger or the heat exchanger is divided into two pieces and positioned on either side of the burner.

BRIEF DESCRIPTION OF THE DRAWINGS

The present invention will now be elucidated with reference to the annexed figures, in which.

Figure 1:
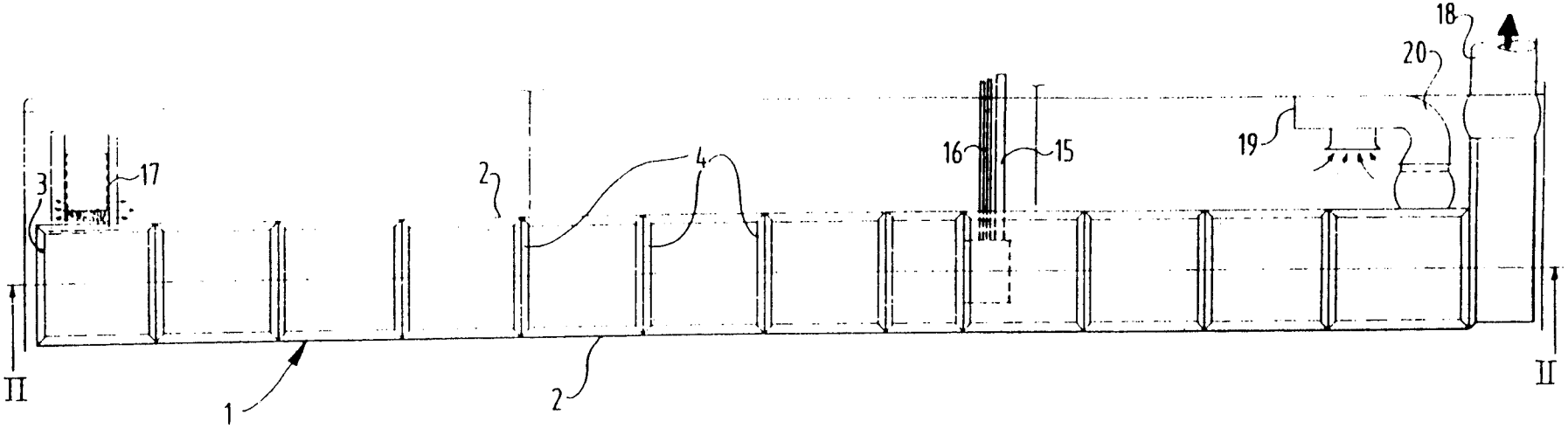
FIG. 1 shows a side view of the first embodiment of a burner unit according to the invention.
Figure 2:
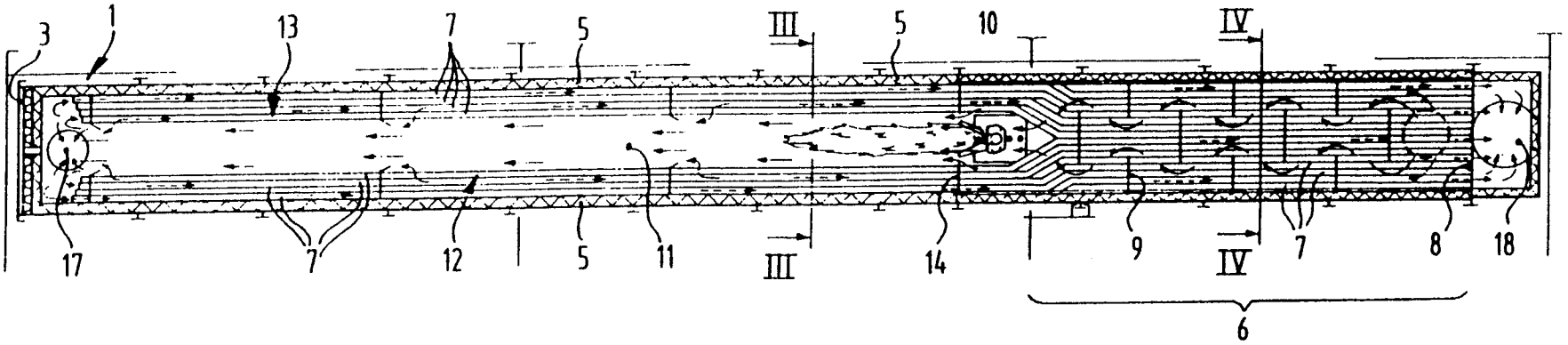
FIG. 2 shows a horizontal sectional view along the line II—II in FIG. 1.

The burner unit depicted in FIG. 1 is formed by a casing 1 manufactured from plate material and reinforced by longitudinal profiles 2, transverse profiles 3 and struts 4. Arranged on the inner side of the plate material 1 is a layer of insulating material 5 as can be seen in FIG. 2.

A heat exchanger 6 is arranged in the casing 1 on the right-hand side in the drawings. The heat exchanger 6 is formed by tubes extending in lengthwise direction of casing 1. On the right-hand side in the drawing the tubes are fixed by welding into a tube plate 8 which also forms the closure of the heat exchanger. The tubes are hereby also fixed at one of their ends. Arranged at regular distances in the heat exchanger are dividing plates 9 extending transversely of the tubes which on the one hand serve to fix the tubes 7 and on the other force the gas passing between the tubes into contact with as many tubes as possible to increase the effectiveness of the heat exchanger. On the left-hand side of the heat exchanger in the drawing, in order to create space for the burner and the combustion chamber, the tubes 7 are bent into an S-shape so that they are collected in two bundles between which the combustion chamber 11 is located. In both bundles 12, 13 the density of the tubes is greater than in the heat exchanger 6; the number of tubes is the same while the available diameter is smaller. The tubes are here also fixed by means of dividing plates 14 in which holes are of course made for passage of the tubes.

Arranged between both bundles of tubes 12, 13 is the combustion chamber 11 in which is fixed a burner 10. A fuel supply duct 15 is arranged for feeding fuel to the burner 10, while an operating member 16 is further arranged for adjusting the burner.

Arranged at the end of the combustion chamber 11 on the burner unit is an outlet duct 17 which serves to discharge a portion of the combustion gases produced in the combustion chamber. For this purpose a remotely controllable valve (not shown) can be arranged in the outlet duct 17. The remaining portion of the combustion gases produced in the combustion chamber 11 is guided into the end of the tubes 7. The part of the tubes 7 extending along the combustion chamber 11 serves herein only for transport of combustion gases and the part of the tubes 7 situated in the heat exchanger serves of course to transfer the heat to the gases for heating.

The combustion gases leaving the heat exchanger are discharged via a second outlet duct 18. This latter leads to a chimney outlet with which the combustion gases are discharged to the outside. Otherwise arranged for supplying the gases for heating is a fan 19 which sucks in the gases for heating and feeds them via a feed duct 20 to heat exchanger 6. Such a burner unit can be applied for instance in a drier for printed material, as described for example in the Netherlands patent application 8902825 already cited above. Herein, gas present in the drying space and containing evaporated solvents and oils is sucked in by means of the fan 19 and fed to the heat exchanger 6 via the duct 20. After the gas for heating has there been at least partially heated, further heating takes place in the burner 10, wherein the evaporated solvents and oils also burn. The heated gas mixture then becomes available via duct 17 and is there fed back to the drying chamber.

Figure 3:
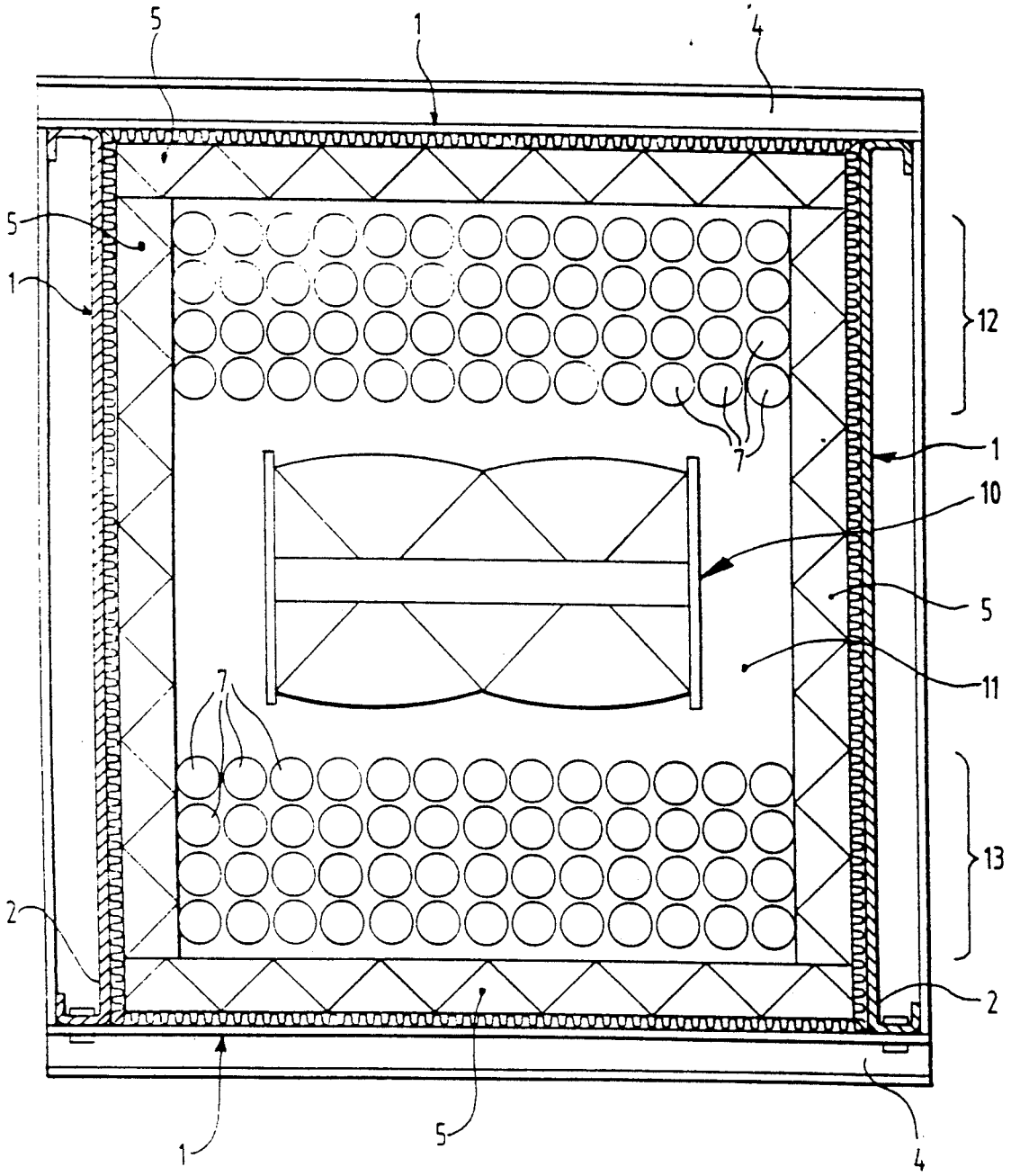
FIG. 3 shows a cross-sectional view along the line III—III in FIG. 2.

FIG. 3 shows a cross sectional view of the burner unit as according to FIG. 1 and 2, this along the line III—III in FIG. 2. It can be seen here how both bundles of tubes 12, 13 display a great density of the tubes; the tubes almost touch each other. Space is made between both bundles 12, 13 for the burner 10, wherein this latter is placed in combustion chamber 11.

Figure 4:
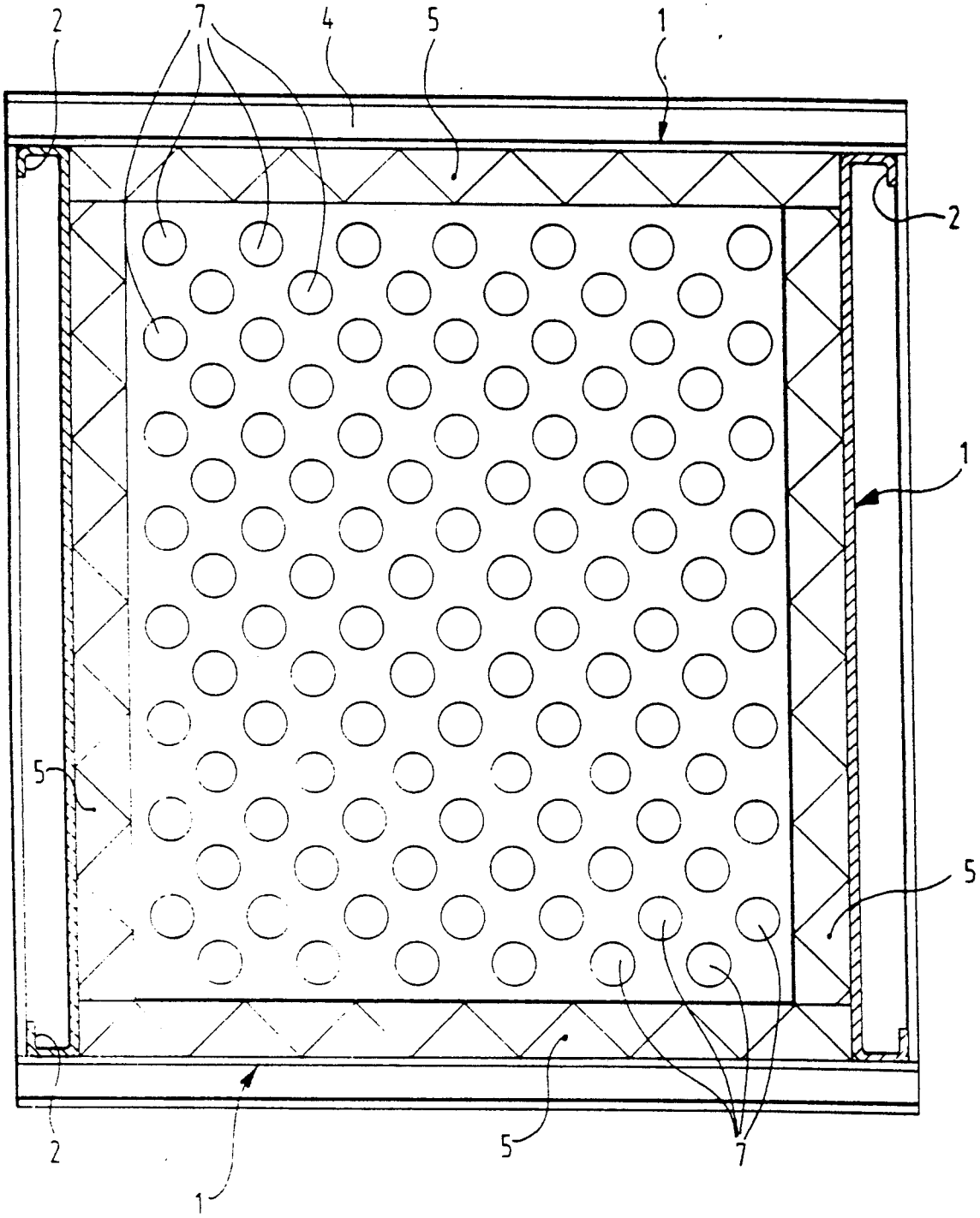
( FIG. 4 is a cross-sectional view along the line IV—IV in FIG. 2.

In similar manner FIG. 4 shows a cross section of the heat exchanger 6 over the line IV—IV in FIG. 2. Clearly visible here is that the space between the tubes 7 at the position of the heat exchanger is much larger; the tubes have a much smaller density here. This is necessary to provide sufficient space for gases flowing through between the tubes.

Figure 5:
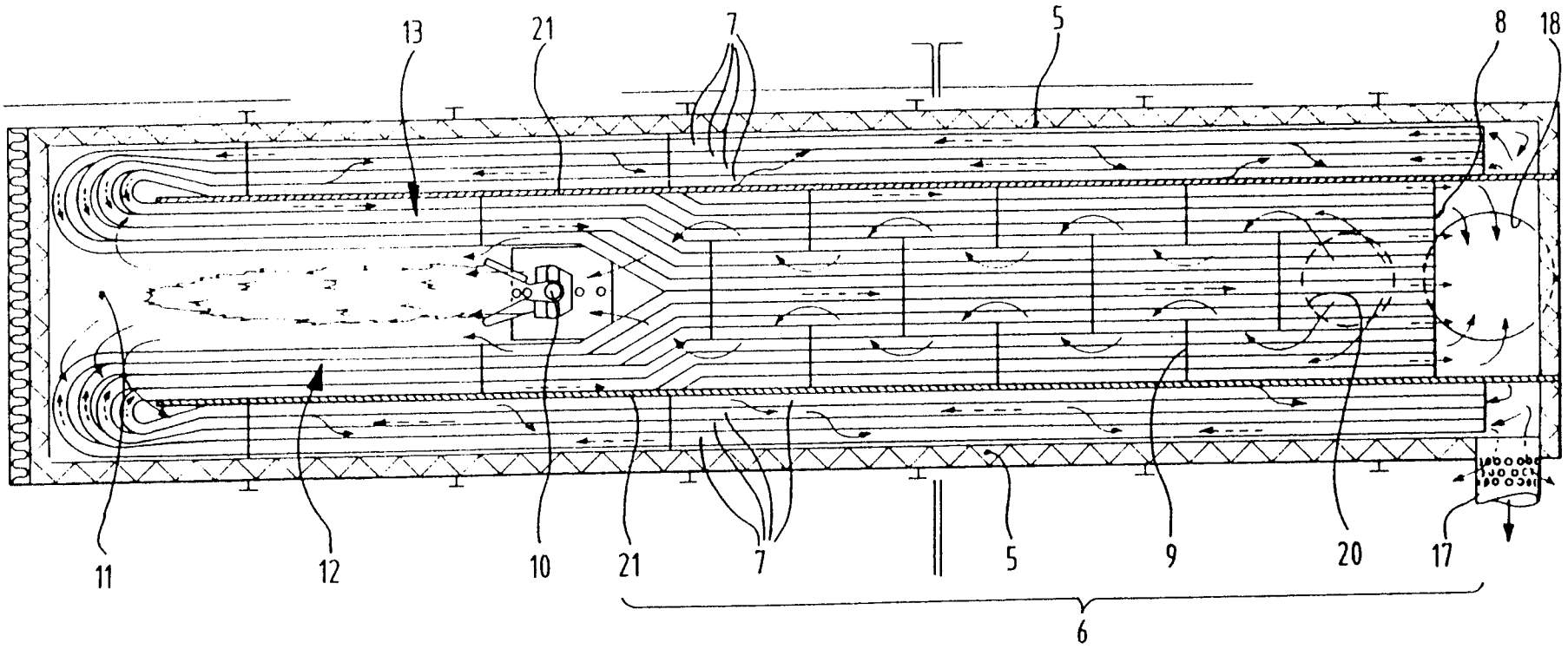
FIG. 5 is a horizontal sectional view of a first alternative embodiment of the burner according to the invention.

Shown in FIG. 5 is a first alternative embodiment of the burner unit. The objective of this first alternative embodiment is to reduce the construction length of the initially described embodiment of the burner unit, wherein the cross section is however enlarged, Since the construction of this first alternative embodiment does not differ essentially from the initially described embodiment the description will be limited only to the differences; corresponding components are designated with the same reference numerals.

In this embodiment also, the whole burner unit is accommodated in a casing 1 wherein however the casing has a greater width and a shorter length. The heat exchanger and a part of the tube bundles 12, 13 are bounded by dividing walls 21 on the outer side of which is arranged the part of the tubes 7 serving as connecting duct. The density of the tubes 7 in the part outside the dividing walls 21 is herein such that sufficient passage remains between the tubes for transport of the combustion gases coming from the combustion space 11. The space between the tubes 7 functions in any case also as a part of the combustion space.

The combustion gases arriving at the end of the tubes 7 are partly discharged via the outlet duct 17, which is thus in changed position, and partly fed back into the tubes 7 which carry the remaining portion of the combustion gases to the heat exchanger 6 and subsequently discharge them via the outlet duct 18.

For manufacture of a burner unit according to this embodiment the tubes 7 must be accurately bent; although this is in itself a cost-increasing operation, the fitting conditions may be such that this is necessary.

Figure 6:
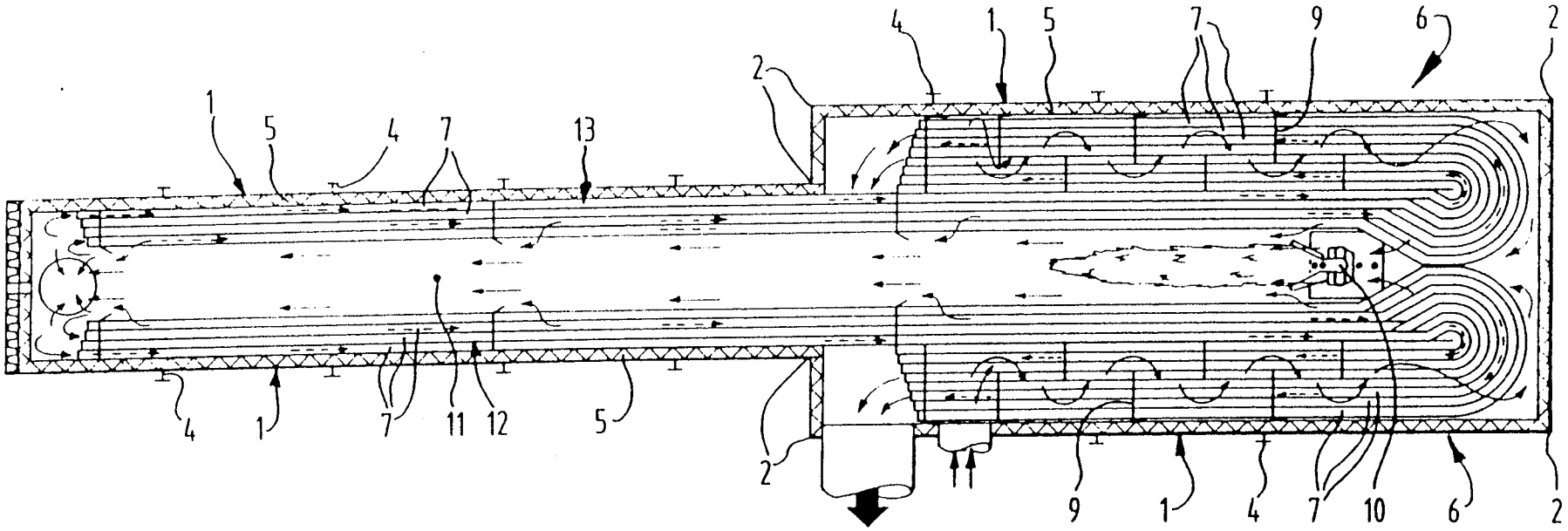
FIG. 6 shows a horizontal sectional view of a second alternative embodiment of the burner according to the invention.

Similar considerations apply with respect to the embodiment shown in FIG. 6. The heat exchanger is here divided into two pieces which are arranged on either side of the combustion chamber. Here too the components correspond with the components discussed in the preceding embodiments and the operation of the whole device remains the same; only diverse components have a different position.

We claim:

1. A burner unit for heating a gaseous medium comprising:

a heat exchanger comprising tubes having first and second ends, said tubes being parallel and spaced apart from one another along at least of part of their length so as to define a space between the tubes, said space between the tubes having an upstream located side and a downstream located side wherein the first ends of the tubes extend out and away from the heat exchanger, and the upstream located side of the space between the tubes is connected to a feed duct for the gaseous medium;

a combustion chamber adjacent the heat exchanger, said combustion chamber having an upstream located side and a downstream located side, wherein the upstream located side of the combustion chamber is connected to the downstream located side of the space between the tubes, the tubes pass along the entire length of the combustion chamber, and the downstream located side of the combustion chamber is connected to the first ends of the tubes;

a burner placed in the combustion chamber;

a fuel supply duct connected to the burner;

and a flue gas outlet duct connected to the second ends of the tubes.

2. A burner unit as claimed in claim 1, further comprising an outlet duct for discharge of heated gases connected to the downstream located side of the combustion chamber.

3. A burner unit as claimed in claim 1, wherein the burner unit is adapted for burning flammable constituents contained in the gaseous medium to be heated.

4. A burner unit as claimed in claim 1, wherein the second ends of the tubes are fixedly attached to a plate located adjacent the upstream located side of the space between the tubes.

5. A burner unit as claimed in claim 1, wherein the tubes are arranged with a greater cross sectional density where they pass along the downstream located side of the combustion chamber than where the tubes pass along the upstream located side of the space between the tubes.

6. A burner unit as claimed in claim 5, wherein the tubes are disposed in two groups along at least a portion of their length so as to define an intermediate space, within the combustion chamber, in which the burner is placed.

7. A burner unit as claimed in claim 1, wherein the tubes are substantially straight and the combustion chamber extends along substantially the full length of the tubes which extends out and away from the heat exchanger.

8. A burner unit as claimed in claim 1, wherein the part of the combustion chamber in which the burner is placed extends over only a part of the length of the tubes extending out and away from the heat exchanger and the tubes are bent through an angle of approximately 180°.

9. A burner unit as claimed in claim 8, wherein the first ends of the tubes extend to an end of the heat exchanger remote from the combustion chamber.

10. A burner unit as claimed in claim 1 wherein the heat exchanger is divided into two substantially equal parts which are arranged on opposite sides of the burner and the tubes are provided with a bend of approximately 180°.

11. A burner unit as claimed in claim 1, wherein the burner unit has a cross section that is at least partially round.

12. A drying device for a material treated with evaporated solvents, comprising a burner unit as claimed in claim 1.

* * * * *